United States Patent [19]

Eiss

[11] Patent Number: 4,855,972

[45] Date of Patent: Aug. 8, 1989

[54] WATCH CASE FOR TENNIS BRACELET

[75] Inventor: Martin Eiss, Freeport, N.Y.

[73] Assignee: Ajco Jewelry Co. Inc., New York, N.Y.

[21] Appl. No.: 220,562

[22] Filed: Jul. 18, 1988

[51] Int. Cl.[4] ..... G04B 37/00; A44C 5/00

[52] U.S. Cl. ..... 368/282; 224/170; 224/173

[58] Field of Search ..... 368/281-282, 368/285; 224/170, 173

[56] References Cited

U.S. PATENT DOCUMENTS 2,740,569 4/1956 Bohlinger et al. ..... 368/282

2,840,286 6/1958 Schermerhorn ..... 368/282

FOREIGN PATENT DOCUMENTS 339876 9/1959 Switzerland ..... 368/282

*Primary Examiner*—Vit W. Miska

*Attorney, Agent, or Firm*—Notaro & Michalos

[57] ABSTRACT

A watch case assembly includes male and female latches which correspond respectfully to the male and female latches of a tennis bracelet. In this way the male latch of the tennis bracelet can be connectd to the female latch of the watch case while the female latch of the bracelet can be connected to the male latch of the watch case. To avoid an overly long bracelet plus watch case combination, part of the length of the bracelet is wrapped around part of the periphery of the watch case and held to the periphery by a bracket.

6 Claims, 2 Drawing Sheets

WATCH CASE FOR TENNIS BRACELET

FIELD AND BACKGROUND OF THE INVENTION

The present invention relates in general to jewelry, and in particular to a new and useful watch case which can be utilized in conjunction with a so-called "tennis bracelet".

Tennis bracelets are known which commonly comprise a gold chain with a stone setting at each link of the chain for receiving a diamond or other precious stone. When worn, the bracelet thus form a continuous line of stones around the wrist of the wearer.

The latch of a tennis bracelet generally includes a male part which engages into a female part for securely fixing the bracelet to the wrist of the wearer. The bracelet is generally about 7 inches in length to closely fit around the wrist of the average wearer.

SUMMARY OF THE INVENTION

The present invention comprises a watch case which is specially constructed to attach between the male and female parts of a bracelet in general, and of a tennis bracelet in particular.

The watch case is itself approximately 1 inch across. Simply connecting the bracelet to the watch case would increase the effective length of the bracelet to about 8 inches. This would produce an unacceptable loose fit.

In accordance with the present invention, part of the bracelet at each end is wrapped around part of the watch case and held to the watch case by a bracket. This returns the effective length of bracelet to its optimum length of about 7 inches, despite the presence of the watch case. The watch case is advantageously surrounded by stones which match the stones on the tennis bracelet. This produces a particularly attractive combination in view of the face that the ends of the tennis bracelet are partly wrapped around the periphery of the case.

Accordingly an object of the present invention is to provide a watch case assembly for connection to a bracelet having first latch means at one end, second latch means at an opposite end and a selected effective length, the assembly comprising a watch case having a periphery, first and second latch means connected to the periphery and spaced from each other on the periphery, the first and second latch means of the watch case corresponding respectively to the first and second latch means of the bracelet whereby the watch case can be connected between the first and second latch means of the bracelet, and bracket means connected to the periphery of the watch case for engaging at least part of the length of the bracelet to wrap at least part of the length of the bracelet around the periphery of the watch case so that with the watch case connected to the bracelet, the bracelet plus watch case has the same selected effective length as the bracelet alone.

A further object of the present invention is to provide a watch case which is simple in design and rugged in construction while maintaining the esthetic beauty of the bracelet.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

Figure 1:
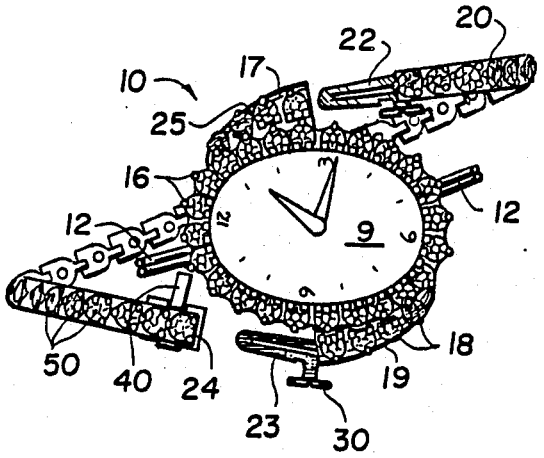
Figure 2:
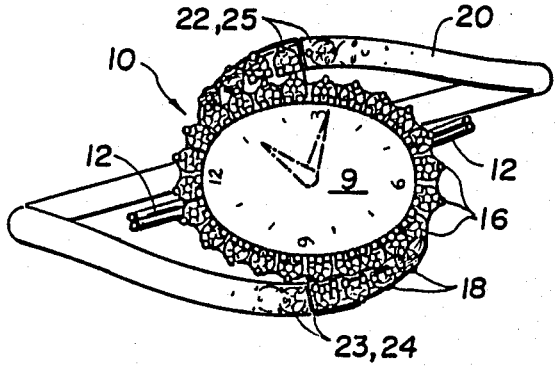
Figure 3:
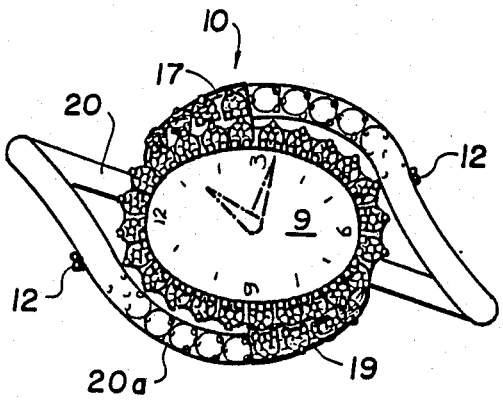
Figure 4:
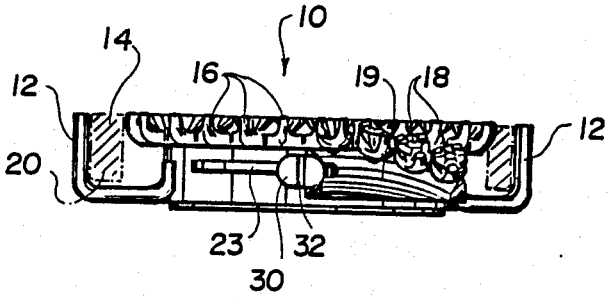
Figure 5:
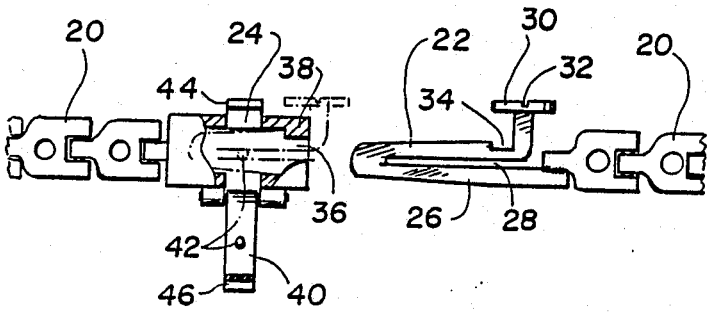

IN THE DRAWINGS:

FIG. 1 is a top plan view of the watch case in accordance with the invention, showing the bracelet in a position about to be connected to the watch case;

FIG. 2 is a view similar to FIG. 1 showing the first and second latch means of the bracelet latched to the first and second latch means of the watch case;

FIG. 3 is a view similar to FIG. 2 showing the final assembly of watch case plus bracelet with part of the length of the bracelet being wrapped around and held by brackets along the periphery of the watch case so that the watch case plus bracelet has the same effective length of the bracelet alone;

FIG. 4 is a side elevational view of the watch case showing the contour of the brackets; and FIG. 5 is a bottom plan view, partly in section, of the first and second latch means which are used both on the watch case and on the bracelet.

DESCRIPTION OF THE PREFERRED EMBODIMENT

Referring to the drawings in particular, the invention embodied therein comprises a watch case assembly generally designated 10 which can be connected between the ends of a bracelet generally designated 20, which is advantageously of the type known as a "tennis bracelet".

Braclet 20 has a male latch 22 which can engage into a female latch 24.

As best shown in FIG. 5, male latch 22 which forms first latch means for one end of the bracelet 20, has a U-shaped blade 26 which is made of resilient metal and includes a slot 28 that divides the blade into two parts. One part can be squeezed toward the other part by pressing a push button 30 to reduce the size of slot 28. Push button 30 is provided with a shallow slot or recess 32 which can be engaged by the nail of a person wishing to press push button 30 to more positively engage the push button. Blade 26 also includes a latch recess 34.

The width of blade 26 is slightly greater than the width of a slot 36 in the female latch 24 which forms second latch means for the bracelet 20. To connect one end of the bracelet to the opposite end of the bracelet, blade 26 is inserted into slot 36 until latch recess 34 snaps into engagement with a detent 38 which is on one side of the blade receiving slot 36.

This effectively locks male latch 22 to female latc 24.

For added security, a gate 40 is pivotally mounted to one side of female latch 24 on a shaft which extends in the plane of FIG. 5. Gate 40 can be pivoted up and over slot 36. Gate 40 is held in this position by engagement of a gate recess 46 on the end of gate 40 with a gate projection 44 on one side of female latch 24.

Gate 40 carries a centrally located post 42 which is engageable into slot 28 in blade 26 when the blade 26 is in the slot 36. With post 42 in slot 28, the two halves of blade 26 cannot be moved together despite any amount of pressing on push button 30. In this way latch recess 34 cannot be inadvertently disengaged from detent 38. To disconnect one end of the bracelet from the other, gate 40 must first be opened and brought to the position shown in FIG. 5.

In accordance with the invention as illustrated in FIG. 1, first and second latch means 23 and 25 respectively are connected to opposite sides of the periphery of watch case assembly 10. First latch means 23 corresponds functionally and structurally to the male latch 22 on one end of bracelet 20 while second latch means 25 corresponds substantially to the female latch 24 on the other end of the bracelet. In this way, the male latch 22 of bracelet 20 can be engaged into the female latch 25 of watch case assembly 10. In likewise fashion, female latch 24 of bracelet 20 can be engaged onto male latch 23 on the watch case assembly.

FIG. 2 shows the watch case assembly 10 connected across the first and second latch means of the bracelet 20. In this position however, the effective length of the bracelet 20 would be longer than if the watch case were absent. So as to provide the bracelet plus watch case combination with the same effective length as the bracelet alone, L-shaped brackets 12 are connected at diametrically opposed locations on the periphery of watch case assembly 10. As shown in FIG. 4, each bracket 12 defines an upwardly open entry passage 14 with the watch case. Passage 14 is about as wide as the bracelet 20 so that the bracelet can be engaged snugly with the bracket on opposite sides of the watch case as shown in FIG. 3. A short length 20*a* of bracelet 20 at opposite ends of the bracelet thus follows the outer periphery of the watch case. By wrapping part of the bracelet around parts of the watch case, the effective length of the bracelet is reduced. In this way the effective length of the bracelet plus watch case combined is about the same as the effective length of the bracelet alone.

Although one example of a male and female latch mechanism has been shown, any latch mechanism having first and second latch means can be utilized both for the bracelet and for the watch case.

As shown in FIG. 1, the watch case assembly includes a plurality of stone settings 16 extending around the periphery of the watch case. These substantially mimic the plurality of stone settings 50 on bracelet 20. Additional stone settings 18 are provided on hoods 17 and 19. Hood 17 conceals the female latch 25 while hood 19 receives that blade of the male latch 23. As shown in FIG. 3, with the bracelet latched to the watch case, an attractive concentric distribution of stones is produced. The outer partial circle of stones is provided partly by the stones on the bracelet lengths 20*a* and partly by the stones on the hoods 17 and 19.

Hood 19 being substantially empty can also be used to conceal the stem of a watch mechanism 9 which is seated in the watch case assembly 10.

While a specific embodiment of the invention has been showed and described in detail to illustrate the application of the principles of the invention, it will be understood that the invention may be embodied otherwise without departing from such principles.

What is claimed is:

1. A watch case assembly for connection to a bracelet having first and second latch means on opposite ends of the bracelet for engagement with each other to close the bracelet, the bracelet having an effective length, said assembly comprising:

a watch case having a periphery;

first and second additional latch means corresponding respectively to the first and second latch means of the bracelet, at diametrically opposed positions on the watch case periphery whereby said first and second additional latch means are respectively engageable with the second and first latch means of the bracelet for connecting the watch case to the bracelet; and a pair of brackets connected at diametrically opposed positions on said watch case periphery for engaging the bracelet adjacent its ends, each bracket being spaced away from said first and second additional latch means whereby part of the length of the bracelet extends along said watch case periphery with the bracelet engaged with said brackets so that the effective length of the watch case plus bracelet is substantially the same as the effective length of the bracelet alone.

2. An assembly according to claim 1 wherein said first and second additional latch means comprise respective male and female latches.

3. An assembly according to claim 1 wherein each of said brackets comprises an L-shaped bracket connected to said watch case periphery.

4. An assembly according to claim 3 wherein said first additional latch means comprises a hood connected to said watch case periphery and a male blade connected to said hood and extending outwardly from said hood, said second additional latch means comprising a second hood connected to said watch case periphery and defining a female latch of a shape to receive a male latch corresponding to said male blade.

5. An assembly according to claim 1 including a plurality of stone settings circumferentially spaced around said periphery.

6. An assembly according to claim 4 including a plurality of stone settings circumferentially spaced around said periphery and a plurality of stone settings on each hood.

* * * * *